US007337723B2

(12) United States Patent
Koekemoer et al.

(10) Patent No.: US 7,337,723 B2
(45) Date of Patent: Mar. 4, 2008

(54) DETONATOR ARMING

(75) Inventors: Andre Louis Koekemoer, Boksburg (ZA); Albertus Abraham Labuschagne, Brakpan (ZA)

(73) Assignee: Detnet South Africa (Pty) Ltd., Sandton (ZA)

( * ) Notice: Subject to any disclaimer, the term of this patent is extended or adjusted under 35 U.S.C. 154(b) by 66 days.

(21) Appl. No.: 10/564,623

(22) PCT Filed: Jun. 25, 2004

(86) PCT No.: PCT/ZA2004/000071

§ 371 (c)(1),
(2), (4) Date: May 30, 2006

(87) PCT Pub. No.: WO2005/005912

PCT Pub. Date: Jan. 20, 2005

(65) Prior Publication Data

US 2006/0207461 A1 Sep. 21, 2006

(30) Foreign Application Priority Data

Jul. 15, 2003 (ZA) ..... 2003/5446

(51) Int. Cl.
*F42C 15/40* (2006.01)
*F42B 3/12* (2006.01)

(52) U.S. Cl. ..... 102/264; 102/221; 102/206; 102/215; 102/218

(58) Field of Classification Search ..... 102/200, 102/206, 215, 217, 218, 221, 262, 264; 361/248, 361/249, 251

See application file for complete search history.

(56) References Cited

U.S. PATENT DOCUMENTS

| | | | | |
|---|---|---|---|---|
| 4,685,396 | A | 8/1987 | Birse et al. | 102/206 |
| 4,860,653 | A | 8/1989 | Abouav | 102/200 |
| 5,460,093 | A | 10/1995 | Prinz et al. | 102/217 |
| 6,584,907 | B2 * | 7/2003 | Boucher et al. | 102/217 |

FOREIGN PATENT DOCUMENTS

| | | |
|---|---|---|
| WO | WO 92/08932 | 5/1992 |
| WO | WO 2005/005912 A2 * | 1/2005 |

OTHER PUBLICATIONS

International Search Report and Written Opinion for PCT/ZA2004/000071, mailed Jan. 5, 2005, 11 pages.
International Preliminary Examination Report on Patentability for PCT/ZA2004/000071, mailed Jan. 11, 2006, 5 pages.

* cited by examiner

*Primary Examiner*—James S Bergin
(74) *Attorney, Agent, or Firm*—Cantor Colburn LLP

(57) ABSTRACT

A detonator which, once armed, is automatically disarmed after a predetermined time period in the absence of at least one defined signal during such time period.

1 Claim, 1 Drawing Sheet

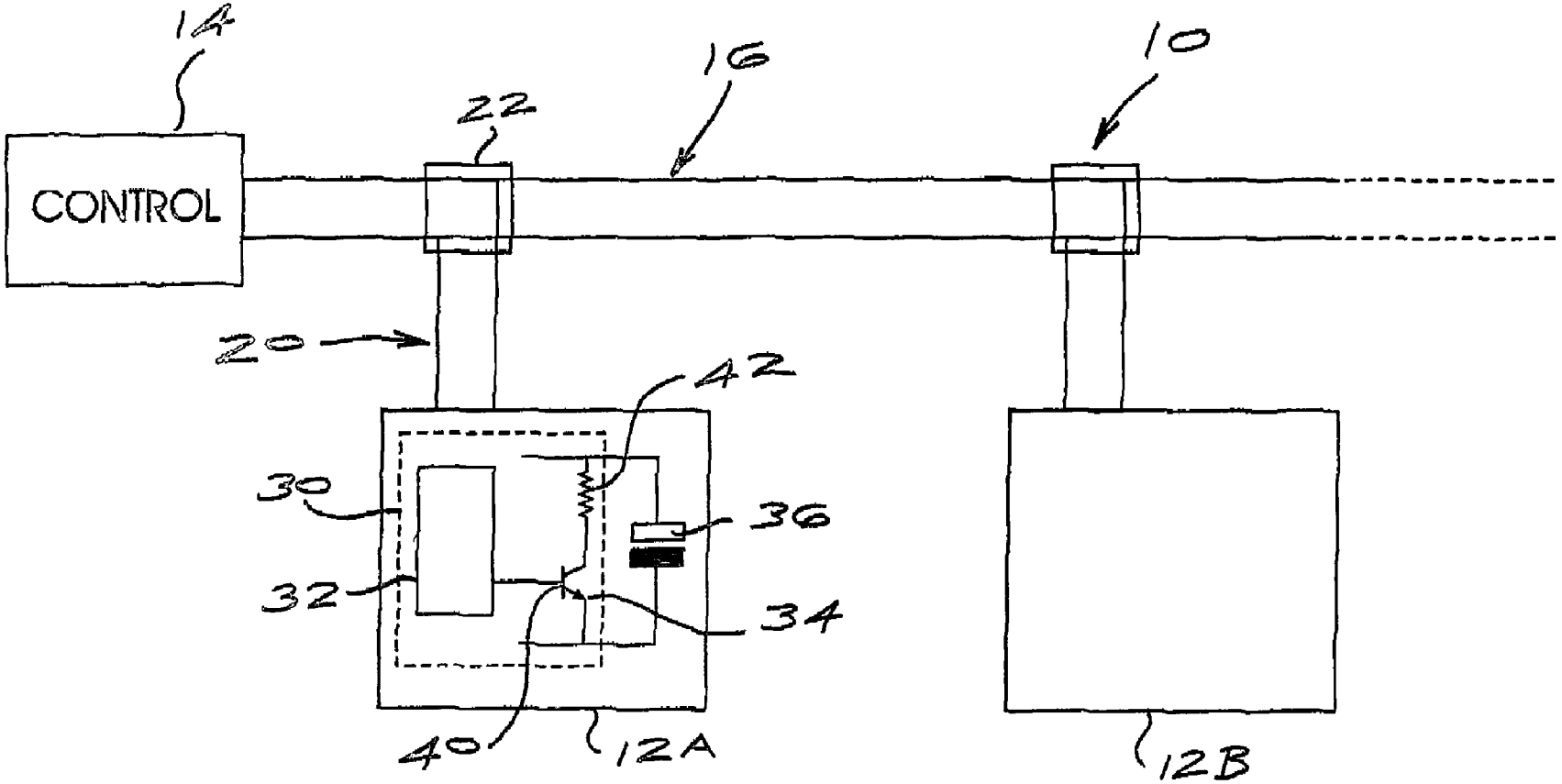
10
16
22
14
CONTROL
20
30
32
40
42
36
34
12A
12B

DETONATOR ARMING

BACKGROUND OF THE INVENTION

This invention is concerned generally with an electronic blasting system and more particularly is concerned with a process whereby a detonator or a series of detonators may be rendered safe regardless of the state of the blasting system or of the integrity of a communications system which is used in the blasting system.

A blasting system usually incorporates means for testing the wiring in the system and connections between the detonators and a blast controller. During a testing phase and also during a programming phase power must be applied to one or more of the detonators, an operation which raises the risk of an unintended event such as a blast. The risk is increased if one or more detonators are in an armed state and a need to abort the blast arises. For example a detonator could remain in a armed state and not respond to a disarm signal if there is a poor connection in a communication system which is used in the blasting system, if a detonator is intermittently faulty, if a cable is damaged, due to the ingress of moisture or for any other reason which interferes with communication between one or more detonators in the system, and a blast controller.

If a detonator does not disarm, despite the transmission of a disarm signal, eg. from a blast controller, then the detonator can remain in the armed state for many hours and, if reconnected to a blasting system, the detonator will remain armed, a condition which could result in an unintended blast.

It is also practice, when a disarm mode is required, to wait a predetermined time period to allow energy which is stored at each detonator to dissipate to a level which is low enough to ensure that initiation of an explosive cannot take place. The energy at each detonator is normally stored in a capacitor and as the capacitor discharge is exponential it can be necessary to wait for a considerable period. If however energy discharge takes place along a path which is defective or damaged then it cannot be said with certainty that, after a predetermined time period, the energy level at the detonator is sufficiently low to render it safe. An allied factor is that electronic components and circuits which are associated with the detonator might not function satisfactorily, due to a low voltage supply, and settings of the detonator might be lost, creating an undefined and unsafe condition.

SUMMARY OF INVENTION

The invention provides a method of controlling operation of a detonator which includes the steps of arming the detonator and, if at least one defined signal is not received by the detonator within a predetermined period after arming the detonator, of placing the detonator in a known safe state.

The defined signal may be a blast signal or it may be a confirming signal, referred to herein as an "arm-hold" signal. The effect of the detonator receiving an arm-hold signal is preferably to cause the timing of the predetermined period to be recommenced.

Thus the method may require the arm-hold signal to be received at regular intervals in order to maintain the detonator in the armed state.

For additional security the arm signal, the arm-hold signal and the blast signal may be encrypted or use may be made of an acceptable secure communications protocol—this reduces the likelihood of the detonator reacting to a stray or erroneous signal.

The invention also provides a detonator which includes an energy storage device, an energy discharge circuit and a control unit which, after the detonator has been armed, in the absence of receipt by the control unit of at least one defined signal from a blast controller, enables the energy discharge circuit thereby to cause energy to be discharged from the storage device.

BRIEF DESCRIPTION OF THE DRAWING

The invention is further described by way of example with reference to the accompanying drawing which illustrates, in block diagram form, part of a blasting system in which an armed state of each detonator is controlled in accordance with the principles of the invention.

DESCRIPTION OF PREFERRED EMBODIMENT

The accompanying drawing illustrates, in block diagram form, part of a blasting system 10 which includes a string of electronic delay detonators 12A, 12B . . . connected to a blast controller 14 by means of a wiring harness 16.

Each detonator is connected to the harness by a respective cable 20 and connector 22.

The construction of each detonator is not fully described herein for the principles of the invention can, within reason, be applied to most electronic delay detonators which are known in the art. The following description is confined to those aspects of the detonator which are necessary for an understanding of the invention.

The detonator includes a control unit 30 shown in dotted outline which contains a controller 32 and an energy discharge circuit 34. The controller 32 could be a processor or other suitable hardware, optionally under software control, a logic unit or the like. The invention is not limited in this respect. An energy storage device 36, typically a capacitor, is incorporated in the detonator. The capacitor is used to store energy which is used, inter alia, to initiate blasting, when required. The circuit 34 includes a switch 40, such as a transistor or other semiconductor switch, and a load 42 which is normally a resistor.

As part of a normal blast sequence each detonator 12 must be armed before it can be fired. This process is an integral part of a safe set-up and operating procedure for the blasting system. A detonator is said to be in an armed state when the capacitor 36 has been charged with sufficient energy to fire the detonator and when the controller 32 has been instructed by the blast controller 14, by following a predefined sequence of steps, to enter the armed state.

In the armed state the detonator only needs a fire command or blast signal, from the blast controller, to initiate an explosive charge to which the detonator is exposed.

Once a detonator 12 has been placed in the armed state the controller 32 continuously monitors the cable 20 for an arm-hold signal from the blast controller. The arm-hold signal is generated by the blast controller 14 according to predetermined criteria and must appear on the cable 20 at regular defined intervals in order for the detonator 12 to be held in the armed condition. If the controller 32 detects the non-appearance of the arm-hold signal within any of the defined intervals then at the end of such interval the controller causes the switch 40 in the energy discharge circuit to close whereupon the energy in the capacitor 36 is dissipated in the load 42. The detonator is thereby automatically placed in a safe condition. If the arm-hold signal is detected then the processing system 32 recommences a timing period of the duration of the interval during which it again acts to detect the appearance of the arm-hold signal.

The aforementioned process means that the detonator is automatically disarmed if any loss of control occurs or if the integrity of any connection to the detonator is defective.

As indicated the arm-hold signal, which is of a defined format, is required to appear at regular intervals to enable the detonator to be held continuously in the armed state. Alternatively or additionally, if a blast signal is not received from the blast controller within a predetermined period after the detonator is placed in the armed state, a factor which is detected by the controller 32, then a similar process can be carried out automatically in that the controller 32 can cause closure of the switch 40 so that the energy in the capacitor 36 is dissipated.

The arm, arm-hold and blast signals can be encrypted, or can be sent using a secure communications protocol, to enhance the security of the blast system.

The invention claimed is:

1. A method of controlling operation of a detonator which includes an energy storage device, an energy discharge circuit and a control unit, the method including the steps of arming the detonator and, if a defined signal is not received by the detonator within a predetermined period after arming the detonator, of using the control unit to enable the energy discharge circuit thereby to cause energy to be discharged from the storage device and place the detonator in a known safe state, the method being characterized in that the defined signal is an arm-hold signal which causes the timing of the predetermined period to be recommenced and which is generated at regular defined intervals.

* * * * *